US006551016B2

(12) United States Patent
Guidon

(10) Patent No.: US 6,551,016 B2
(45) Date of Patent: Apr. 22, 2003

(54) PAVER GUID-ON SYSTEM

(76) Inventor: John Kevin Guidon, 5205 New Kent Rd., Richmond, VA (US) 23225

( * ) Notice: Subject to any disclaimer, the term of this patent is extended or adjusted under 35 U.S.C. 154(b) by 0 days.

(21) Appl. No.: 09/817,381

(22) Filed: Mar. 27, 2001

(65) Prior Publication Data

US 2002/0141821 A1 Oct. 3, 2002

(51) Int. Cl.[7] ..... E01C 5/00
(52) U.S. Cl. ..... 404/73
(58) Field of Search ..... 404/17, 18, 34, 404/35, 38, 73; D25/113; 414/10, 930, 931

(56) References Cited

U.S. PATENT DOCUMENTS

| | | | | | |
|---|---|---|---|---|---|
| 3,427,936 | A | * | 2/1969 | van der Meijden | 404/73 |
| 3,820,912 | A | * | 6/1974 | Hughes | 14/69.5 |
| 4,681,482 | A | * | 7/1987 | Arciszewski et al. | 14/2.4 |
| 4,684,288 | A | * | 8/1987 | Chapa | 404/35 |
| 4,846,601 | A | * | 7/1989 | Luijten | 404/73 |
| 5,131,787 | A | * | 7/1992 | Goldberg | 404/32 |
| 5,160,215 | A | * | 11/1992 | Jensen | 404/35 |
| 5,163,777 | A | * | 11/1992 | Krueger et al. | 404/41 |
| 5,250,340 | A | * | 10/1993 | Bohnhoff | 404/36 |
| D379,670 | S | * | 6/1997 | Karanikas | D25/113 |
| 6,047,520 | A | * | 4/2000 | Caraballo | 52/749.11 |
| 6,171,015 | B1 | * | 1/2001 | Barth et al. | 404/34 |
| 6,267,531 | B1 | * | 7/2001 | Clarke | 249/4 |

OTHER PUBLICATIONS

Eurocobble 15th Anniversary Updated Catalog and specification; date 2000.*
Copy of Walkmaker product packaging, four pages. Date unknown.

* cited by examiner

*Primary Examiner*—Gary S. Hartmann
(74) *Attorney, Agent, or Firm*—John H. Thomas, P.C.

(57) ABSTRACT

A paver system is made up of a plurality of pavers. The pavers are adhered onto a grid, and a handle is attached to the grid to enable the system to be carried by an installer. The grid onto which the pavers are adhered may be flexible. There may be a plurality of handles, and the handles may be connected by a band fastener. A paver installation may have a prearranged pattern using multiple paving systems.

5 Claims, 3 Drawing Sheets

PAVER GUID-ON SYSTEM

BACKGROUND OF THE INVENTION

The Paver Guid-on System relates to the manufacture of a system of any masonry paving products which have been pre-arranged on a flexible grid for ease of installation. It is a system that simplifies the process of placing the pavers on the setting bed allowing even an amateur to achieve professional installations of sidewalks, patios and driveways with less effort than is traditional. But, to understand the contribution of the paver Guid-on System, it is necessary to understand both the increasing demand for paver products and how these pavers are currently installed.

The popularity of decorative masonry paving seems to be steadily increasing, and sand-set, mortarless paving is one of the most popular methods of installation. This method eliminates the use of concrete slabs and mortar between paving units. One advantage of using a dry or sand-set method of installation is to prevent cracks in the pavement as the subsoil expands and contracts over time. The sand-set system allows for movement of air and moisture through the sand and joints making a healthier surround for nearby plants. Also, sand set paving units can be easily replaced if the area is damaged by spills or unforseen settlement in the sub-grade. Repairs can be completed while maintaining the aesthetic integrity of the system But, this method of installation is both labor intensive and difficult. The paver Guid-on is designed to relieve the installer of both of those burdens while providing a finished product that looks like it was installed by a professional.

Masonry paving units, usually made out of concrete, clay and sometimes asphalt, are commonly referred to as pavers. These pavers are commonly used for city street scape projects, commercial plazas and residential driveways, sidewalks, and patios The popularity of these individual masonry units have prompted a large number of manufactures to create a wide variety of colors and shapes of pavers with an eye toward the ever-growing residential market. In addition to widening the choices of pavers commercially available, the manufactures are seeking ways to increase sales by making the pavers easier for both homeowners and contractors to install.

The problem lies in taking the pavers from their packaged form (usually three to five hundred individual units stacked on a pallet) and installing them, one paver at a time, into complicated patterns and designs on the site and making the end result look like a professional installation. Accomplishing this while maintaining the flexibility and aesthetic qualities of a professional installation has proven to be a challenging task. In the past manufacturers have tried kits that include a pallet of pavers with precut pieces with some basic instructions, but trying to put those pieces together was labor intensive, limited design capability, usually looked unprofessional, and were often made packaged with too many or too few pieces in the kits.

Manufacturers have also created pavers that are large, for example 18"×18", with a stamped pattern or pieces already mortared together. But these stamped slabs, too, have proven to be too labor intensive, are heavy and hard to handle, are inflexible, have very limited installation patterns and designs, and the end result simply doesn't look professional.

A more popular recent attempt to simplify the installation process is the poured in place concrete paving stones. The manufacturer offers the installer plastic concrete forms, color additive for the concrete and instructions in how to mix, color, and pour the concrete in place. This system has its drawbacks in that it requires mixing concrete which is messy and labor intensive. Also, when amateur installers (such as homeowners) use color additives the end result is often inconsistent. The process is labor intensive, lacks flexibility, can only be used for light pedestrian traffic, and usually eventually cracks.

The Eurocobble® paving product is composed of multiple pre-arranged paving stones. The product is mortared together and is composed of natural stone products, like granite. The Eurocobble® is rigid in nature and is primarily designed to be set on concrete with mortared joints. Though convenienttly pre-packaged , this product lacks structural flexibility and is relatively heavy and awkward to move around the work site.

My last example of previous attempts at simplifying the installation process is the paver trays. These are plastic trays that serve as a template for laying patterns. Paver tray systems are labor intensive and require purchasing and handling multiple plastic trays with a limited choice of pattern. This process also still requires the cutting of pavers to finish edges and homeowner-installers are usually unprepared for mastering this step. The end product often hap gaps between pavers which are usually large because of space between trays, and the finished installations usually look very unprofessional.

The Paver Guid-on eliminates these disadvantages and results in a professional looking, flexible installation.

BRIEF SUMMARY OF INVENTION

The Paver Guid-on segmental masonry paving system comprises individual segmental pavers adhered to a flexible grid in prearranged patterns with a removable handle. It solves the problems stated above by having the individual pavers pre-attached to a background with a pre-established pattern, much the way sheets of kitchen and bathroom tiles are purchased. The patterns may vary greatly allowing the layman to create more professional looking installations while eliminating the guesswork of trying to determine how the pattern is created.

Although installation still involves manual labor, it is greatly decreased because each unit in the system is equipped with removable handles for ease of installation. The handle serves as a spacer between the system units eliminating the large gaps caused by other systems. The handle also provides easy transport of the system from the pallet to the setting bed.

The system offers precut pieces to complete paved edges and eliminates the need for homeowners to make difficult and sometimes unwieldy cuts. The pavers are adhered to a flexible mesh so they can be installed on a flexible setting bed. This allows for all of the benefits of a flexible paving system. If so desired, the system can even be installed on a concrete slab and the joints can be mortared.

Eliminating the need for homeowners to mix colors, Paver Guid-on systems can be constructed of any masonry paving unit available, increasing the buyers choice of color, shape, material and pattern, and eliminating the inconsistency that results from mixing colors in wet cement at home. They can also be constructed with a cobble paver (referred to as Cobble Guid-ons) and provide a unique pattern that minimizes the length of paver joint lines. This adds to the Guid-on's structural, interlocking integrity and provides the paved area a more random and aesthetically pleasing appearance.

The Paver Guid-on system offers instructions on installing different patio shapes that can be achieved with the pre-cut pattern thereby increasing the number of patterns available for easy installation.

The Paver Guid-on takes a variety of masonry paving units, commonly known as pavers, and pre-constructs the patterns on a flexible grid that can be easily transported from the pallet to the work area. Many of these patterns are commonly known, yet complex to construct. The Paver Guid-on System (and cobble Guid-ons) have created flexibility, ease of handling and installation, pattern variety, strength, and given both the homeowner and the contractor a method for constructing professional looking sidewalks, patios, driveways and any other horizontal structures which could be built with pavers or cobblestones.

Other details, uses, and advantages of this invention will become apparent as the following description of the exemplary embodiments thereof presented in the accompanying drawings proceeds.

BRIEF DESCRIPTION OF THE DRAWINGS

The accompanying drawings show exemplary embodiments of this invention, in which.

DETAILED DESCRIPTION OF THE INVENTION

Reference is now made to FIGS. 1–3C of the drawings which illustrate the embodiment of a few Guid-on systems showing the specific and sometimes unique parts which will work together to provide the advantages described in the Summary of this document.

Figure 1A:
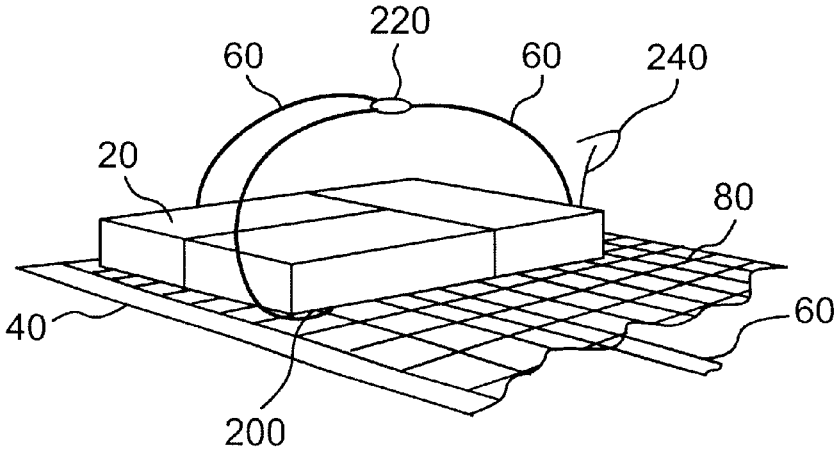
FIG. 1A is an isometric view of the segmental paving system and parts combined

FIG. 1 is just one type of segmented paver system which illustrates the inclusion of 20, a type of segmented paver attached to 80, a grid of flexible material that could be plastic, with 40, a paper to catch excessive adhesive, attached below the grid, 80. These pavers are set in the desired pattern which is designed to fit right next to other Paver Guid-ons until the entire desired design is accomplished. Each system segment is carried by the installer from the pallet to the prepared bed by holding 60, the plastic bands which have been attached to the system to creating handles. The handles 60 are held together by 220, a band fastener. Once in place, the handles 60 are designed to provide the proper spacing between the Guid-ons then be snipped away along with the band fastener 220 so that when the installation is completed, one would not be able to tell where one system ended and another one began.

Figure 1B:
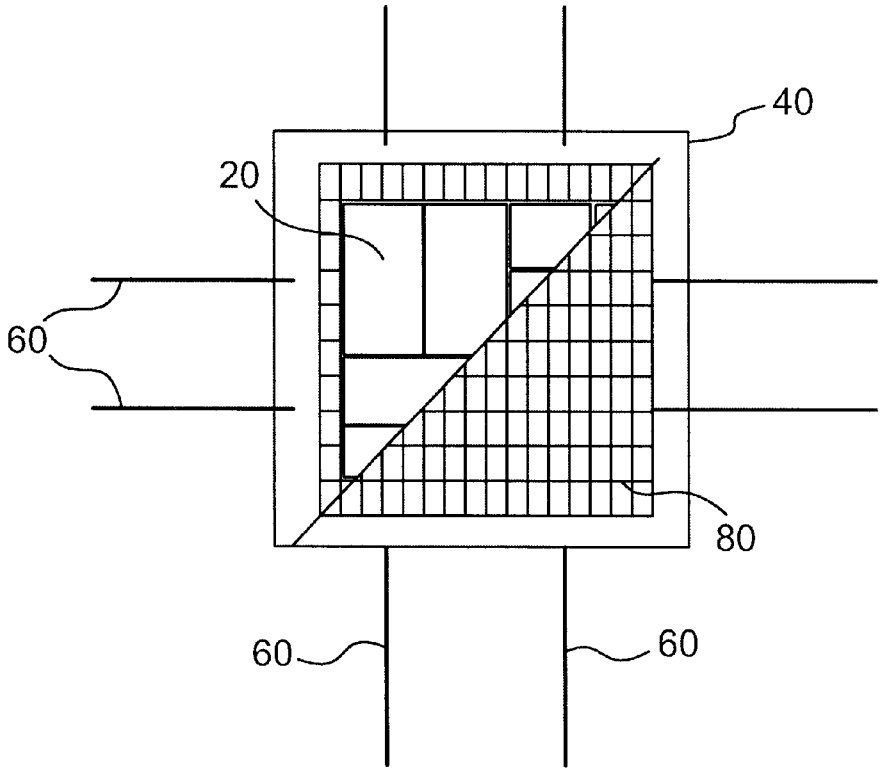
FIG. 1B is a plan view of the segmental paving system all parts combined.

FIG. 1B shows a different view, including a cut-a-way. This plan view shows the pavers 20 attached to the flexible grid 80 and the paper beneath the grid 40 designed to catch excess glue which could seep through the grid during the manufacturing process. In this view, the handles 60 can also be seen. These handles 60 are joined at the top with a band fastener 220 used to hold the handles together for ease of carrying by the installer.

Figure 2A:
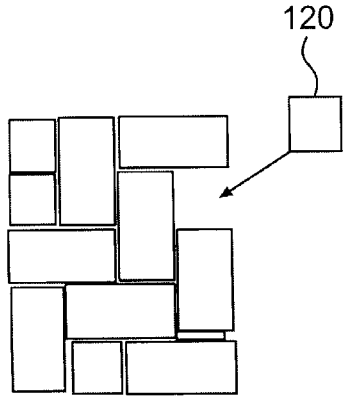
FIG. 2A is a plan view of a commonly know pattern used in system cut pavers provided to complete paved edge.
Figure 2B:
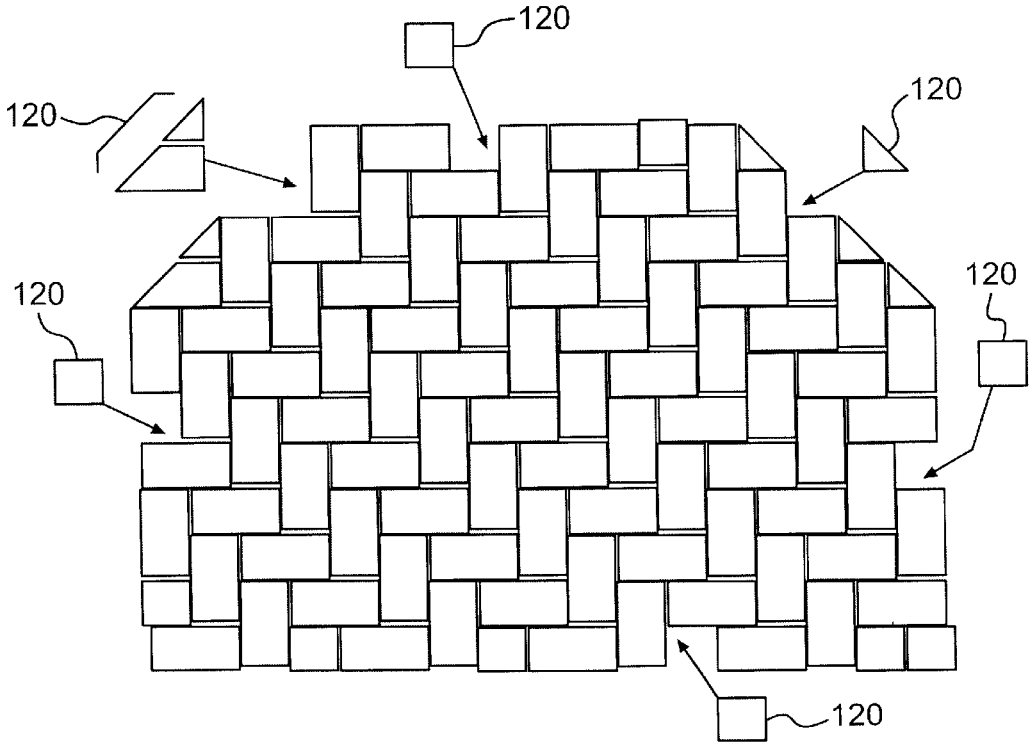
FIG. 2B is a plan view of a paving systems suggested pavement design layout using systems pre-cut segmental pavers and prearranged patterned paving system.

These systems can be designed in any pattern the customer desires and be manufactured to provide the customer with a complete set of Paver Guid-ons which sit on the prepared bed and form the final product such as a patio, sidewalk, driveway or other structure. FIG. 2A shows one type of design which is one segment of the entire system. FIG. 2B shows a series of FIG. 2A segments after they have been fitted together to form a larger pattern with specially cut pieces 120 included to complete the larger finished product.

Figure 3A:
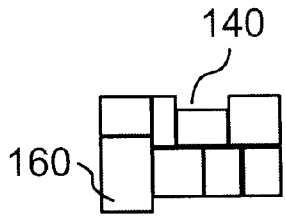
FIG. 3A is a plan view of a pattern, referred to as a Cobble Guid-on that is specially designed for this system using commonly know shapes designed to interlock for structural and aesthetic integrity.
Figure 3B:
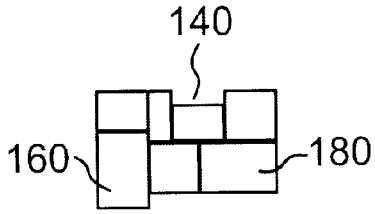
FIG. 3B is a plan view of a Cobble Guid-on showing a different variation of FIG. 3A. substituting a different paver showing the ability to diversify randomness using the system.
Figure 3C:
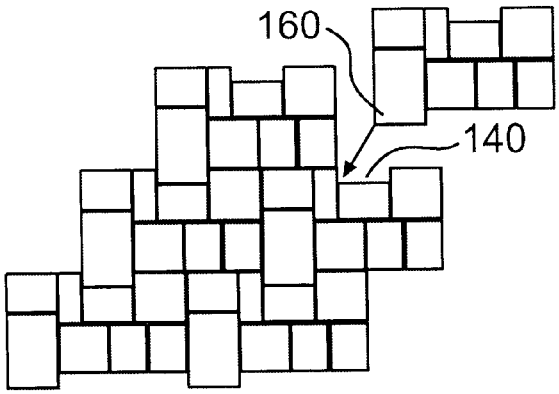
FIG. 3C is a plan view of a Cobble Guid-on which shows how the specially designed paving patterns FIG. 3A and FIG. 3B fit together to form a larger, uniform unit giving the paved area an interlocking quality and random appearance.

To illustrate how different these patterns can be, FIG. 3A and 3B have been placed together, putting piece 140 against piece 160 in FIG. 3C. This shows how the end user can be finished a product of intricate design that requires only simple assembly with no complicated pattern to figure out.

What I claim as my invention is:

1. A paver system comprising:

a plurality of pavers, a grid adhered to the bottom of each of the pavers; and a handle attached to the grid; the handle being comprised of a band connected to the grid at a plurality of locations and extending from the grid above the top of the pavers, whereby the system can be easily carried by an installer.

2. A paver system as described in claim 1, further comprising a plurality of handles.

3. A paver system as described in claim 2, further comprising a band fastener connected to the plurality of handles.

4. A paver system as described in claim 1, wherein the grid is made of flexible material.

5. A paver system as described in claim 1, further comprising a layer of paper adhered to the grid on the opposite side of the grid from the pavers.

* * * * *